US006342328B1

(12) United States Patent
Takasaki et al.

(10) Patent No.: US 6,342,328 B1
(45) Date of Patent: Jan. 29, 2002

(54) TONER FOR DEVELOPMENT OF ELECTROSTATIC CHARGE IMAGE AND METHOD FOR PRODUCING THE SAME

(75) Inventors: Takahiro Takasaki; Kazu Niwa; Kojiro Masuo; Kazuhiro Sato, all of Kanagawa (JP)

(73) Assignee: Nippon Zeon Co., Ltd., Tokyo (JP)

( * ) Notice: Subject to any disclaimer, the term of this patent is extended or adjusted under 35 U.S.C. 154(b) by 0 days.

(21) Appl. No.: 09/623,448

(22) PCT Filed: Mar. 31, 1999

(86) PCT No.: PCT/JP99/01681

§ 371 Date: Sep. 5, 2000

§ 102(e) Date: Sep. 5, 2000

(87) PCT Pub. No.: WO99/52019

PCT Pub. Date: Oct. 14, 1999

(30) Foreign Application Priority Data

Mar. 31, 1998 (JP) ..... 10-104124
May 15, 1998 (JP) ..... 10-150787

(51) Int. Cl.[7] ..... G03G 9/097
(52) U.S. Cl. ..... 430/108.22; 430/137.15; 430/138
(58) Field of Search ..... 430/106, 109, 430/110, 111, 108.22, 137.15, 138

(56) References Cited

U.S. PATENT DOCUMENTS

| | | | |
|---|---|---|---|
| 4,883,735 A | | 11/1989 | Watanabe et al. |
| 5,002,847 A | | 3/1991 | Utsumi et al. |
| 5,212,033 A | | 5/1993 | Tsubota et al. |
| 5,346,797 A | * | 9/1994 | Kmiecik-Lawrynowicz et al. ..... 430/110 |
| 5,597,673 A | | 1/1997 | Watanabe et al. |

FOREIGN PATENT DOCUMENTS

| | | |
|---|---|---|
| JP | 57-045558 | 3/1982 |
| JP | 59-062870 | 4/1984 |
| JP | 59-116757 | 7/1984 |
| JP | 60-103359 | 6/1985 |
| JP | 60-173552 | 9/1985 |
| JP | 62-262055 | 11/1987 |
| JP | 63-38948 | 2/1988 |
| JP | 63-184762 | 7/1988 |
| JP | 1185656 | 7/1989 |
| JP | 2167565 | 6/1990 |
| JP | 2259657 | 10/1990 |
| JP | 3161761 | 7/1991 |
| JP | 3015858 | 10/1991 |
| JP | 3243954 | 10/1991 |
| JP | 4-195166 | 7/1992 |
| JP | 05-119535 | 5/1993 |
| JP | 8-123096 | 5/1996 |
| JP | 08-314186 | 11/1996 |
| JP | 09-096924 | 4/1997 |
| JP | 09-197804 | 7/1997 |
| JP | 09-230630 | 9/1997 |
| JP | 10-020555 | 1/1998 |
| JP | 3203746 | 8/1999 |

* cited by examiner

*Primary Examiner*—John Goodrow
(74) *Attorney, Agent, or Firm*—Dinsmore & Shohl LLP

(57) ABSTRACT

A toner for development of electrostatic images, comprising at least a binder resin, a colorant and a charge control agent, wherein the charge control agent is a polar resin composed of a copolymer of a vinyl monomer and $SO_3X$ (X=H or alkali metal) group-containing (meth)acrylamide and having an $SO_3X$ group-containing (meth)acrylamide unit content of 0.1 to 10 wt. % and a weight average molecular weight of 17,000 to 25,000, and a production process of the toner.

12 Claims, No Drawings

TONER FOR DEVELOPMENT OF ELECTROSTATIC CHARGE IMAGE AND METHOD FOR PRODUCING THE SAME

TECHNICAL FIELD

The present invention relates to a toner for development of electrostatic images for developing electrostatic latent image s formed by an electrophotographic process, electrostatic recording process or the like, and a production process thereof.

BACKGROUND ART

In general, in an image forming apparatus such as an electrophotographic apparatus or electrostatic recording apparatus, an electrostatic latent image (electrostatic image) is formed on a photosensitive member uniformly and evenly charged by exposure to a light pattern, and a developer (toner) is applied to the electrostatic latent image to form a toner image (visible image). The toner image is transferred to a transfer medium such as paper or OHP film, and the toner image thus transferred is then fixed to the transfer medium by a method such as heating, pressing or use of solvent vapor. In the fixing step, the toner is often fusion-bonded to the transfer medium by passing the transfer medium, to which the toner image has been transferred, through between a heating roll (fixing roll) and a press roll to press-bond the toner under heat.

A toner for development of electrostatic images is generally composed of colored resin particles (colored polymer particles) comprising a binder resin and a colorant. Processes for producing the toner for development of electrostatic images are roughly divided into a grinding process and a polymerization process. In the grinding process, a colorant, a charge control agent, a parting agent and the like are melted and mixed in a thermoplastic resin to prepare a resin composition, the resin composition is then ground and classified, thereby producing a toner (ground toner) composed of colored resin particles. In the polymerization process, a monomer composition containing a polymerizable monomer, a colorant, a charge control agent, a parting agent and the like, which are uniformly dissolved or dispersed therein, is poured into water or an aqueous dispersion medium composed mainly of water, which contains a dispersion stabilizer, and the mixture is stirred until droplets become stable. A polymerization initiator is added to the mixture, and the monomer composition is dispersed by means of a mixer having high shearing force to form the monomer composition into fine droplets. The droplets are polymerized to form a toner (polymerized toner) composed of colored polymer particles. According to the polymerization process, a polymerized toner having a desired particle diameter and a sharp particle diameter distribution can be obtained without conducting grinding and classification.

In copying machines, printers and the like of an electrophotographic system, it has recently been attempted to reduce demand power. A step in which energy is particularly demanded in the electrophotographic system is the so-called fixing step conducted after transferring a toner from a photosensitive member to a transfer medium. A heating roll heated to a temperature of at least 150° C. is generally used for fixing, and electric power is used as an energy source therefor. There is a demand for lowering the temperature of the heating roll from the viewpoint of energy saving.

Besides, the speeding-up of copying and printing has been strongly required with the advancement of the combination of image forming apparatus and the formation of personal computer network. In such high-speed copying machines and high-speed printers, it is necessary to conduct fixing in a shorter time.

In order to meet such requirements from the image forming apparatus in the design of a toner, it is only necessary to lower a glass transition temperature of a binder resin. When the glass transition temperature of the binder resin is lowered, however, the resulting toner becomes poor in the so-called shelf stability because particles themselves of the toner undergo blocking during storage or in a toner box to aggregate.

On the other hand, in the case of color toners used in the electrophotographic system, development is generally conducted with color toners of 3 or 4 different colors to transfer the resulting toner image to a transfer medium at a time or by 3 or 4 installments, and the toner image is then fixed. Therefore, the thickness of the toner layer to be fixed becomes thicker compared with a black-and-white image. In addition, the respective color toners overlapped are required to be uniformly melted, and so the melt viscosity of each toner at about the fixing temperature thereof must be designed low compared with the conventional toners. Means for lowering the melt viscosity of the toner include, for example, methods in which the molecular weight of a resin used is made lower compared with the resins for the conventional toners, and in which the glass transition temperature thereof is lowered. In any of these methods, however, the toner becomes poor in shelf stability because the toner tends to undergo blocking.

As described above, there is an adverse correlation between the shelf stability of a toner and the means for coping with the lowering of the fixing temperature of the toner, the speeding-up of printing and the formation of color images. As means for solving this adverse correlation, it has heretofore been proposed to solve the problem of shelf stability by taking measures to additives, or covering colored polymer particles having a low glass transition temperature with a polymer having a high glass transition temperature to form a toner (capsule toner) of a core-shell structure.

However, with respect to the additives, importance is attached to the role of imparting various functions such as charge properties and parting ability, and so it has been difficult to well balance the shelf stability of a toner with the fixing ability and the like thereof by such additives. Description is given taking, for example, a charge control agent as an example.

In order to cause a toner to adhere to an electrostatic latent image on a photosensitive member by electrostatic attraction force to make the latent image visible, it is necessary to control the charge property of the toner. A negatively or positively charged toner is used according to the kinds of a developing system and a photosensitive member. In order to control the charge property of the toner, a charge control agent is generally used. However, the charge control agents heretofore used have involved various problems.

More specifically, metal complex compounds have heretofore been mainly used as charge control agents for imparting negatively charge property to a toner. However, the kinds of metals thereof are heavy metals such as chromium, manganese and cobalt, and so the metal complex compound have involved a problem of safety.

Japanese Patent Application Laid-Open No. 262055/1987 has proposed a process for producing colored fine particles having an average particle diameter of 1 to 5 $\mu$m comprising a pigment, a zinc alkylsalicylate complex and a binder resin, said process comprising subjecting the pigment, the zinc alkylsalicylate complex and a monomer for forming the binder resin to suspension polymerization in the presence of a water-insoluble inorganic salt and then decomposing the water-insoluble inorganic salt to dissolve it in water. However, the suspension polymerization of the monomer composition containing the metal complex compound has involved problems that the dispersion stability of droplets is lowered, and the droplet diameter thereof is made small.

In order to solve the problem of safety in the metal complex compounds, Japanese Patent Application Laid-Open Nos. 184762/1988, 167565/1990, 15858/1991 and 243954/1991 have proposed that a copolymer of a styrene monomer and a sulfonic group-containing acrylamide is used as a charge control agent. When a copolymer having a copolymerization ratio of styrene and/or a-methylstyrene to 2-acrylamido-2-methylpropanesulfonic acid of 98:2 to 80:20 and a weight average molecular weight of 2,000 to 15,000, which is specifically shown in these publications, is used as a charge control agent, however, the dispersibility of a colorant becomes insufficient, and environmental dependence of toner images obtained from such a toner is also insufficient.

In Japanese Patent Application Laid-Open Nos. 184762/1988 and 167565/1990 described above, a styrene/2-acrylamido-2-methylpropanesulfonic acid copolymer is used as a charge control agent in ground toners. However, the glass transition temperature of the copolymers specifically disclosed is as high as 82 to 94° C. In Japanese Patent Application Laid-Open Nos. 15858/1991 and 243954/1991 described above, a copolymer of a styrene monomer and a sulfonic group-containing acrylamide compound is used as a charge control agent is used as a charge control agent in polymerized toners. However, with respect to the copolymers actually used in these publications, the calculated glass transition temperature thereof is at least 90° C. The use of the charge control agent having such a high glass transition temperature make it difficult to well balance the charge property with the lowering of the fixing temperature.

As described above, the conventionally known sulfonic group-containing copolymers have a relatively low molecular weight and a high glass transition temperature, and so fully satisfactory toner properties have been unable to be achieved when they have been used as charge control agents.

On the other hand, various techniques have been proposed on the production process of a capsule toner (for example, Japanese Patent Application Laid-Open Nos. 173552/1985, 259657/1990 and 45558/1982, etc.).

As a technique thereof, Japanese Patent Application Laid-Open No. 62870/1984 has proposed a production process of a toner, in which core particles are formed by suspension polymerization, and a monomer capable of providing a polymer having a glass transition temperature higher than that of the core particles to be adsorbed on the core particles to polymerize it. When a metal complex compound such as an acetylsalicylic acid chromium complex is used as a charge control agent as described in Examples of this publication, however, there has been offered a problem that even when it is attempted to disperse droplets of a monomer composition in an aqueous medium by a dispersion stabilizer, the stability of the droplets is not achieved. Such a metal complex compound has strong hydrophilicity, and so the dispersion stability of the droplets of the monomer composition is disturbed when the metal complex compound is dispersed in the monomer composition having strong lipophilicity.

DISCLOSURE OF THE INVENTION

It is an object of the present invention to provide a toner for development of electrostatic images, which involves no problem of safety, has excellent charge stability, is capable of successfully dispersing a colorant therein and can provide images good in durability and low in environmental dependence and excellent in resolution, and a production process thereof.

Another object of the present invention is to provide a toner for development of electrostatic images, which has a low fixing temperature, is well balanced between shelf stability and fixing ability, can meet the speeding-up of printing, and is suitable for use as a color toner, and a production process thereof.

A further object of the present invention is to provide a color toner for development of electrostatic images, which has such excellent properties as described above.

The present inventors have carried out an extensive investigation with a view toward overcoming the above-described problems involved in the prior art. As a result, it has been found that the above-described objects can be achieved by using, as a charge control agent, a copolymer composed of 90 to 99.9 wt. % of a vinyl monomer unit and 0.1 to 10 wt. % of a sulfonic group-containing (meth) acrylamide unit and having a weight average molecular weight of 17,000 to 25,000.

According to the present invention, there is thus provided a toner for development of electrostatic images, comprising at least a binder resin, a colorant and a charge control agent, wherein the charge control agent is a polar resin composed of a copolymer of a vinyl monomer and $SO_3X$ (X=H or alkali metal) group-containing (meth)acrylamide and having an $SO_3X$ group-containing (meth)acrylamide unit content of 0.1 to 10 wt. % and a weight average molecular weight of 17,000 to 25,000.

According to the present invention, there is also provided a process for producing a toner for development of electrostatic images by subjecting a monomer composition containing at least a polymerizable monomer, a colorant and a charge control agent to suspension polymerization in an aqueous dispersion medium containing a dispersion stabilizer, the process comprising using, as the charge control agent, a polar resin composed of a copolymer of a vinyl monomer and $SO_3X$ (X=H or alkali metal) group-containing (meth)acrylamide and having an $SO_3X$ group-containing (meth)acrylamide unit content of 0.1 to wt. % and a weight average molecular weight of 17,000 to 25,000.

According to the present invention, there is further provided a process for producing a toner of a core-shell structure for development of electrostatic images by subjecting a monomer composition containing at least a polymerizable monomer, a colorant and a charge control agent to suspension polymerization in an aqueous dispersion medium containing a dispersion stabilizer, thereby forming colored polymer particles, and then subjecting a polymerizable monomer for shell, which is capable of forming a polymer having a glass transition temperature higher than that of a polymer formed from the first mentioned polymerizable monomer, to suspension polymerization in the presence of the colored polymer particles to form a polymer layer which covers each of the colored polymer particles, the process comprising using, as the charge control agent, a polar resin composed of a copolymer of a vinyl monomer and $SO_3X$ (X=H or alkali metal) group-containing (meth)acrylamide and having an $SO_3X$ group-containing (meth)acrylamide unit content of 0.1 to wt. % and a weight average molecular weight of 17,000 to 25,000.

BEST MODE FOR CARRYING OUT THE INVENTION

1. Polar Resin (charge control resin):

In the present invention, a polar resin composed of a copolymer of a vinyl monomer and $SO_3X$ (X=H or alkali metal) group-containing (meth)acrylamide and having an $SO_3X$ group-containing (meth)acrylamide unit content of 0.1 to 10 wt. % and a weight average molecular weight of 17,000 to 25,000 is used for controlling the resulting toner for development of electrostatic images so as to have negative charge property. The copolymer is of relatively high-molecular weight, and the glass transition temperature thereof is preferably as low as about 30 to 80° C. The $SO_3X$ group-containing (meth) acrylamide will herein after be referred to as "the sulfonic group-containing (meth) acrylamide", and the polar resin may be referred to as "the charge control resin".

(1) Vinyl Monomer:

Typical examples of the vinyl monomer copolymerized with the sulfonic group-containing (meth)acrylamide include vinyl aromatic hydrocarbon monomers and (meth) acrylate monomers.

The vinyl aromatic hydrocarbon monomers are compounds having a structure that a vinyl group is bonded to an aromatic hydrocarbon. Specific examples of the vinyl aromatic hydrocarbon monomers are compounds include styrene, α-methylstyrene, 2-methylstyrene, 3-methylstyrene, 4-methylstyrene, 2-ethylstyrene, 3-ethylstyrene, 4-ethylstyrene, 2-propylstyrene, 3-propylstyrene, 4-propylstyrene, 2-isopropylstyrene, 3-isopropylstyrene, 4-isopropylstyrene, 2-chlorostyrene, 3-chlorostyrene, 4-chlorostyrene, 2-methyl-α-methylstyrene, 3-methyl-α-methylstyrene, 4-methyl-α-methylstyrene, 2-ethyl-α-methylstyrene, 3-ethyl-α-methylstyrene, 4-ethyl-α-methylstyrene, 2-propyl-α-methylstyrene, 3-propyl-α-methylstyrene, 4-propyl-α-methylstyrene, 2-isopropyl-α-methylstyrene, 3-isopropyl-α-methylstyrene, 4-isopropyl-α-methylstyrene, 2-chloro-α-methylstyrene, 3-chloro-α-methylstyrene, 4-chloro-α-methylstyrene, 2,3-dimethylstyrene, 3,4-dimethylstyrene, 2,4-dimethylstyrene, 2,6-dimethylstyrene, 2,3-diethylstyrene, 3,4-diethylstyrene, 2,4-diethylstyrene, 2,6-diethylstyrene, 2-methyl-3-ethylstyrene, 2-methyl-4-ethylstyrene, 2-chloro-4-methylstyrene, 2,3-dimethyl-α-methylstyrene, 3,4-dimethyl-α-methylstyrene, 2,4-dimethyl-α-methylstyrene, 2,6-dimethyl-α-methylstyrene, 2,3-diethyl-α-methylstyrene, 3,4-diethyl-α-methylstyrene, 2,4-diethyl-α-methylstyrene, 2,6-diethyl-α-methylstyrene, 2-ethyl-3-methyl-α-methylstyrene, 2-methyl-4-propyl-α-methylstyrene and 2-chloro-4-ethyl-α-methylstyrene. These vinyl aromatic hydrocarbon monomers may be used either singly or in any combination thereof.

Specific examples of the (meth)acrylate monomers include acrylates such as methyl acrylate, ethyl acrylate, propyl acrylate, isopropyl acrylate, n-butyl acrylate, isobutyl acrylate, n-amyl acrylate, isoamyl acrylate, n-hexyl acrylate, 2-ethylhexyl acrylate, hydroxypropyl acrylate and lauryl acrylate; and methacrylates such as methyl methacrylate, ethyl methacrylate, propyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, hydroxypropyl methacrylate and lauryl methacrylate. These (meth)acrylate monomers may be used either singly or in any combination thereof.

(2) Sulfonic Group-containing (meth)Acrylamide:

Specific examples of the sulfonic group-containing (meth)acrylamide include acids such as 2-acrylamido-2-methylpropanesulfonic acid, 2-acrylamido-n-butanesulfonic acid, 2-acrylamido-n-hexanesulfonic acid, 2-acrylamido-n-octanesulfonic acid, 2-acrylamido-n-dodecanesulfonic acid, 2-acrylamido-n-tetradecanesulfonic acid, 2-acrylamido-2-methylpropanesulfonic acid, 2-acrylamido-2-phenylpropane-sulfonic acid, 2-acrylamido-2,2,4-trimethylpentane-sulfonic acid, 2-acrylamido-2-methylphenylethanesulfonic acid, 2-acrylamido-2-(4-chlorophenyl) propanesulfonic acid, 2-acrylamido-2-carboxymethylpropanesulfonic acid, 2-acrylamido-2-(2-pyridine)propanesulfonic acid, 2-acrylamido-1-methylpropanesulfonic acid, 3-acrylamido-3-methylbutanesulfonic acid, 2-methacrylamido-n-decanesulfonic acid and 4-methacrylamidobenzenesulfonic acid, and alkali metal salts thereof. Examples of the alkali metal salts include sodium salts and potassium salts. These sulfonic group-containing (meth)acrylamides may be used either singly or in any combination thereof.

(3) Composition of Polar Resin:

The copolymerizing proportions of the vinyl monomer and the sulfonic group-containing (meth)acrylamide in the polar resin useful in the practice of the present invention are 90 to 99.9 wt. % for the former and 0.1 to 10 wt. % for the latter. The copolymerizing proportion (hereinafter may be referred to as "wt. % of the functional group") of the sulfonic group-containing (meth)acrylamide is preferably 0.2 to 8 wt. %, more preferably 0.3 to 6 wt. %. If the proportion of the sulfonic group-containing (meth)acrylamide unit is lower than 0.1 wt. %, the ability to control charge of the resulting resin and dispersion of a pigment become insufficient. If the proportion of the unit exceeds 10 wt. %, the dispersion stability of droplets of the monomer composition upon polymerization is lowered, which causes such problem that no toner having a uniform particle diameter can be provided, and the charging of the resulting toner becomes too high.

As the vinyl monomer, the vinyl aromatic hydrocarbon and the (meth)acrylate are preferably used in combination in a weight ratio of generally 95:5 to 60:40, preferably 93:7 to 70:30, more preferably 90:10 to 60:40.

(4) Weight Average Molecular Weight:

The weight average molecular weight (Mw) of the polar resin (sulfonic group-containing copolymer) is 17,000 to 25,000 in terms of polystyrene as measured by gel permeation chromatography (GPC) using tetrahydrofuran. When the glass transition temperature is sufficiently low, those having a low molecular weight up to the weight average molecular weight of about 2,000 may also be used. However, if the weight average molecular weight is too low, the dispersibility of the pigment in the resulting toner is lowered, and difficulty is encountered on the provision of stable charge property. If the weight average molecular weight is too high, handling upon the preparation of toner particles becomes poor, and in the case of a polymerized toner, the viscosity of toner droplets becomes high, and the size of the droplets becomes varied, so that any uniform toner p articles cannot be obtained. The weight average molecular weight of the polar resin is preferably 18,000 to 24,000, more preferably 19,000 to 23,000 though it varies according to the composition of the toner.

(5) Glass Transition Temperature:

No particular limitation is imposed on the glass transition temperature of the polar resin (sulfonic group-containing copolymer) so far as the weight average molecular weight falls within the above range. However, it is preferably within a range of 30 to 80° C., particularly preferably 30 to 70° C. from the viewpoint of well balancing the shelf stability with the fixing ability in the resulting toner.

(6) Polymerization Initiator:

As examples of a polymerization initiator used in the preparation of the sulfonic group-containing copolymer, may be mentioned azo compounds such as 2,2'-azobisisobutyronitrile, 2,2'-azobis(2,4-dimethylvaleronitrile), 2,2'-azobis(4-methoxy-2,4-dimethylvaleronitrile), 2,2'-azobisisobutyrate, 4,4'-azobis(4-cyanopentanoic acid), 4,4'-azobis(4-cyanovaleric acid), 2,2'-azobis-2-methyl-N-1,1'-bis(hydroxymethyl)-2-hydroxyethylpropionamide, 1,1'-azobis(1-cyclohexanecarbonitrile), 2,2'-azobis(2-amidinopropane) dihydrochloride, 2,2'-azobis(N,N'-dimethylisobutylamidine) and 2,2'-azobis(N,N'-dimethylisobutylamidine) dihydrochloride; and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate.

Further, solution polymerization with an initiator for anionic polymerization, such as an alkali metal, butyllithium, a reaction product of an alkali metal and naphthalene, or the like is preferred because the molecular weight of the resulting polymer can be easily controlled.

The amount of the polymerization initiator used can be optionally selected according to the intended weight average molecular weight. Specifically, it is generally 0.01 to 10 parts by weight, preferably 0.1 to 5 parts by weight per 100 parts by weight of the total weight of the monomers used.

(7) Polymerization Process:

As a polymerization process for producing the polar resin (sulfonic group-containing copolymer), may be used any process of emulsion polymerization, dispersion polymerization, suspension polymerization, solution polymerization, etc. However, the solution polymerization is particularly preferred in that the intended weight average molecular weight is easy to achieve.

Examples of a solvent or dispersing agent used in each polymerization process include aliphatic or aromatic hydrocarbon compounds; nitrogen-containing organic compounds such as nitriles, amines, amides and heterocyclic compounds; oxygen-containing organic compounds such as alcohols, ketones, carboxylic acid esters, ethers and carboxylic acids; chlorine-containing organic compounds such as chlorine-substituted products of aliphatic hydrocarbons; and sulfur-containing organic compounds. One or more solvents or dispersing agents may be suitably selected from these compounds.

Polymerization temperature and polymerization time may be optionally selected according to the kinds of polymerization process and polymerization initiator used, and the like. However, the polymerization temperature is generally about 50 to 200° C., and the polymerization time is about 0.5 to 20 hours. Upon polymerization, conventionally known additives, for example, a polymerization aid such as an amine, may also be used in combination. As a method for obtaining a copolymer of the sulfonic group-containing (meth)acrylamide from the reaction system after polymerization, there is used a method in which the reaction mixture is poured into a poor solvent, a method in which the solvent is removed by steam, a method in which the solvent is removed under reduced pressure, a method in which the solvent is removed by heating and melting, a method in which the reaction mixture is lyophilized, or a method in which the polymerization is conducted at a high concentration, and the reaction mixture is added to the polymerization system of a toner as it is.

2. Toner for Development of Electrostatic Images:

The toner according to the present invention may be either a ground toner or a polymerized toner and may be a capsule toner of a core-shell structure.

2-1. Ground toner:

In the grinding process, a binder resin, a colorant, a charge control agent, a parting agent and the like are mixed by means of a mixer such as a Henschel mixer to obtain a composition. The composition is melt and kneaded by means of a kneader such as a twin roll, twin-screw extruder or Busco kneader. The kneaded composition is cooled, ground and classified to obtain a toner having the intended particle diameter. Thereafter, external additives are mixed into the toner as needed, thereby preparing a developer.

The specified polar resin (sulfonic group-containing copolymer) described above is used as the charge control agent. The polar resin is used in a proportion of generally 0.1 to 7 parts by weight, preferably 0.3 to 5 parts by weight per 100 parts by weight of the binder resin. If the compounding proportion of the polar resin is too low, it is difficult to impart sufficient charge property to the resulting toner. If the proportion is too high, problems such as lowering of compatibility, increase of environmental dependence of image quality, occurrence of offset and staining of a photosensitive member are easy to arise.

As the binder resin, a copolymer of a styrene monomer and a (meth)acrylic monomer or polyester is generally used. However, the copolymer of the Styrene monomer and the (meth)acrylic monomer is preferably used from the viewpoint of its good compatibility with the polar resin. Specific examples of the Styrene monomer and the (meth)acrylic monomer are respectively the same as the examples of the polymerizable monomers for the polymerized toner which will be described subsequently. The glass transition temperature of the binder resin is generally 60 to 70° C., preferably 61 to 69° C., more preferably 63 to 67° C. If the glass transition temperature of the binder resin is too low, the shelf stability of the resulting toner becomes poor. If it is too high, the fixing ability of the toner becomes poor. The weight average molecular weight of the binder resin is generally 10,000 to 500,000, preferably 20,000 to 450,000, more preferably 50,000 to 400,000. If the weight average molecular weight of the binder resin is lower than 10,000, the offset temperature of the resulting toner is lowered. If it exceeds 500,000, the fixing ability of the toner is deteriorated.

2-2. Polymerized toner:

Examples of the polymerization process for a polymerized toner include various processes such as an emulsion polymerization process, suspension polymerization process and dispersion polymerization process. However, the suspension polymerization process is preferred in that it is an excellent production process in which neither a solvent nor an emulsifier is used, and the form of the resulting toner is spherical.

In the suspension polymerization process, a monomer composition containing at least a polymerizable monomer, a colorant and a charge control agent is subjected to suspension polymerization in an aqueous dispersion medium containing a dispersion stabilizer to form colored polymer particles.

More specifically, the polymerized toner is produced in accordance with the following process. Namely, raw materials for toner, such as a colorant, a charge control agent, a parting agent and other additives are uniformly dispersed in a polymerizable monomer by means of a mixing and dispersing machine such as a bead mill to prepare a monomer composition. The monomer composition is then dispersed in an aqueous dispersion medium containing a dispersion stabilizer, and the resultant suspension is stirred. An oil-soluble polymerization initiator is added after the droplets of the monomer composition are made uniform, to mix them. The resultant mixture is formed into fine droplets by means of a high-speed shearing stirrer in such a manner that the size thereof becomes smaller to the size of the resulting toner particles, thereby obtaining droplets for toner. No particular limitation is imposed on the method for forming the droplets. However, a method in which a liquid is passed through between a rotor which rotates on its axis at high speed, and a stator surrounding it and having small openings or comb-like teeth is preferred. After forming the droplets, the droplets are subjected to suspension polymerization at a temperature of generally 5 to 120° C., preferably 35 to 95° C. If the polymerization temperature is lower than the temperature within this range, it is necessary to use a polymerization initiator high in catalytic activity, and so it is difficult to control the polymerization reaction. If the polymerization temperature is higher than the temperature with in this range on the other hand, the parting agent tends to bleed into the surface of the resulting toner, and the shelf stability of the toner is hence deteriorated.

In the present invention, the specified polar resin (sulfonic group-containing copolymer) described above is used as the charge control agent. The polar resin is used in a proportion of generally 0.1 to 7 parts by weight, preferably 0.3 to 5 parts by weight per 100 parts by weight of the polymerizable monomer. If the compounding proportion of the polar resin is too low, it is difficult to impart sufficient charge property to the resulting toner. If the proportion is too high, the stability to formation of droplets is lowered.

The dispersed state of the monomer composition is a state that the volume average droplet diameter of droplets of the monomer composition amounts to generally 1 to 12 $\mu$m, preferably 3 to 10 $\mu$m, more preferably 4 to 7 $\mu$m. If the droplets are too great, toner particles formed become too great, so that the resolution of an image formed with such a toner is deteriorated.

A ratio of volume average droplet diameter/number average droplet diameter of the droplets is generally 1 to 3, preferably 1 to 2. If the droplet diameter distribution of the droplets is too wide, the fixing temperature of the resulting toner varies, so that inconveniences such as fogging and filming tend to occur. The droplets desirably have a droplet diameter distribution that at least 30 vol. %, preferably, at least 50 vol. % of the droplets are present within a range of (the volume average droplet diameter ±1 $\mu$m).

In the present invention, it is preferred that a dispersion of the monomer composition be prepared and then charged into a polymerization reactor to conduct polymerization. More specifically, the monomer composition is added to an aqueous medium in a vessel for preparation of a dispersion to prepare a dispersion of the monomer composition. The monomer composition thus dispersed is transferred to another vessel (vessel for polymerization reaction) to conduct polymerization there. According to a process comprising preparing a dispersion in a polymerization reactor and conducting a polymerization reaction as it is like the conventional suspension polymerization process, scale occurs in the reactor, and coarse particles of a toner tend to form in plenty.

No particular limitation is imposed on the time when the polymerization initiator is added. However, the polymerization initiator (generally, an oil-soluble radical initiator) is preferably added and mixed after the colorant, polar resin and optionally added other additives (parting agent, molecular weight modifier, lubricant, dispersion aid, macromonomer, etc.) are added to the polymerizable monomer and uniformly dispersed by means of beads mill or the like to prepare a monomer composition, and the liquid mixture thus obtained is poured into the aqueous dispersion medium and fully stirred to make droplets uniform.

(1) Polymerizable Monomer:

As the polymerizable monomers useful in the practice of the present invention, monovinyl monomers may be mentioned. Specific examples thereof include styrenic monomers such as styrene, vinyltoluene and α-methylstyrene; acrylic acid and methacrylic acid; derivatives of acrylic acid or methacrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monovinyl monomers may be used either singly or in any combination thereof. Among these monovinyl monomers, the styrenic monomers and the derivatives of acrylic acid or methacrylic acid are preferably used.

The polymerizable monomer used in the present invention is such that can form a polymer having a glass transition temperature of generally at most 70° C., preferably 60 to 70° C. If the glass transition temperature exceeds 70° C., it is difficult to lower the fixing temperature of the resulting toner. If the glass transition temperature is lower than 60° C., the shelf stability of the resulting toner may not be satisfactory in some cases. The polymerizable monomers may be often used either singly or in any combination thereof.

The glass transition temperature (Tg) of a polymer is a calculated value (referred to as calculated Tg) calculated out according to the kind(s) and proportion(s) of monomer(s) used in accordance with the following equation:

$$1/Tg=W_1/T_1+W_2/T_2+W_3/T_3+\ldots W_n/T_n$$

wherein

Tg: the glass transition temperature of a copolymer (absolute temperature), $W_1$, $W_2$, $W_3$ . . . $W_n$: % by weight of the specific monomers in a copolymer composition, $T_1$, $T_2$, $T_3$ . . . $T_n$: glass transition temperature (absolute temperature) of a homopolymer formed from each of the monomers.

(2) Crosslinkable Monomer:

When a crosslinkable monomer is used in addition to the polymerizable monomer, the hot offset resistance of the resulting toner can be effectively improved. The crosslinkable monomer is a monomer having two or more polymerizable carbon—carbon unsaturated double bonds. Specific examples thereof include aromatic divinyl compounds such as divinylbenzene, divinylnaphthalene and derivatives thereof; di-ethylenically unsaturated carboxylic acid esters such as ethylene glycol dimethacrylate and diethylene glycol dimethacrylate; divinyl compounds such as N,N-divinylaniline and divinyl ether; and compounds having three or more vinyl groups. These crosslinkable monomers may be used either singly or in any combination thereof. These crosslinkable monomers are used in a proportion of generally 0 to 2 parts by weight, preferably 0.1 to 1 part by weight per 100 parts by weight of the polymerizable monomer (3) Polymerization Initiator:

An oil-soluble radical polymerization initiator is generally used as a polymerization initiator for the polymerizable monomer. As examples of the radical polymerization initiator, may be mentioned persulfates such as potassium persulfate and ammonium persulfate; azo compounds such as 4,4'-azobis-(4-cyanovaleric acid), 2,2'-azobis(2-amidinopropane) bihydrochloride, 2,2'-azobis-2-methyl-N-1,1'-bis(hydroxymethyl)-2-hydroxyethyl-propionamide, 2,2'-azobis(2,4-dimethylvaleronitrile), 2,2'-azobis-isobutyronitrile and 1,1'-azobis(1-cyclohexanecarbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate.

Redox initiators composed of combinations of these polymerization initiators with a reducing agent may also be mentioned.

Of these oil-soluble polymerization initiators, oil-soluble radical initiators selected from among organic peroxides whose decomposition temperature giving a half-life period of 10 hours are 60 to 80° C., preferably 65 to 80° C. and whose molecular weights are 250 or lower are preferred, with t-butyl peroxy-2-ethylhexanoate being particularly preferred because the resulting toner scarcely gives odor upon printing and barely causes environmental destruction by volatile components such as odor.

The amount of the polymerization initiator used is generally 0.1 to 20 parts by weight per 100 parts by weight of the polymerizable monomer. Alternatively, the amount of the polymerization initiator used is generally 0.001 to 3 parts by weight per 100 parts by weight of the aqueous dispersion medium. If the amount of the polymerization initiator used is less than each lower limits of these ranges, the rate of polymerization becomes slow. Any amount exceeding the upper limit results in a polymer having a low molecular weight. It is hence not preferred to use the polymerization initiator in such a too little or great amount.

(4) Molecular Weight Modifier:

As examples of the molecular weight modifier, may be mentioned mercaptans such as t-dodecylmercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization. The molecular weight modifier is used in a proportion of generally 0.05 to 10 parts by weight, preferably 0.1 to 5 parts by weight per 100 parts by weight of the polymerizable monomer.

(5) Parting Agent:

The parting agent is preferably added for the prevention of offset. As specific examples thereof, may be mentioned polyfunctional ester compounds such as pentaerythritol tetramyristate and pentaerythritol tetrastearate; low molecular weight polyolefins such as low molecular weight polyethylene, low molecular weight polypropylene and low molecular weight polybutylene; and paraffin waxes. Of these, those having a melting point of 60 to 120° C. are preferred, with natural gas type Fischer-Tropsch wax being particularly preferred. The parting agent is used in a proportion of generally 0 to 30 parts by weight, preferably 0.1 to 25 parts by weight, particularly preferably 0.5 to 20 parts by weight per 100 parts by weight of the polymerizable monomer.

(6) Lubricant and Dispersion Aid:

Any of various kinds of lubricants such as oleic acid, stearic acid, various waxes, and olefinic lubricants such as polyethylene and polypropylene; a dispersion aid such as a silane or titanium coupling agent; and/or the like may also be used with a view toward uniformly dispersing the colorant in the resulting toner particles. Such a lubricant or dispersion aid is generally used in a proportion of about 1/1,000 to 1/1 based on the weight of the colorant.

(7) Other Charge Control Agent:

The polar resin used in the present invention has charge control performance, and there is hence no need to use any commonly used charge control agent for negative charge. However, such a charge control agent may also be used if desired. The amount of the charge control agent used is 0 to 3 parts by weight per 100 parts by weight of the polymerizable monomer. If the charge control agent is used in an amount more than the upper limit of this range, droplets of the monomer composition formed in the aqueous medium in which the dispersion stabilizer has been dispersed becomes unstable. It is hence preferable to use the charge control agent in an amount less than the amount of the polar resin used.

(8) Macromonomer:

In the present invention, a macromonomer may be added for the purpose of improving a balance between the shelf stability and offset resistance and the low-temperature fixing ability of the polymerized toner. The macromonomer is an oligomer or polymer having a polymerizable vinyl functional group at its molecular chain terminal and a number average molecular weight of generally 1,000 to 30,000. If a macromonomer having a too low number average molecular weight is used, the surface part of the resulting polymerized toner becomes soft, and its shelf stability comes to be deteriorated. If a macromonomer having a too high number average molecular weight is used on the other hand, the melt properties of the macromonomer itself becomes poor, resulting in a toner deteriorated in fixing ability.

In the case of a polymerized toner of a core-shell structure, the macromonomer is preferably such that can give a polymer having a glass transition temperature higher than that of a polymer obtained by polymerizing a polymerizable monomer for core. Incidentally, the Tg of the macromonomer is a value measured by means of an ordinary measuring device such as a differential scanning calorimeter (DSC).

As specific examples of the macromonomer used in the present invention, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton; and those disclosed in Japanese Patent Application Laid-Open No. 203746/1991, pages 4 to 7.

Of these macromonomers, such polymers having a higher glass transition temperature as obtained by polymerizing methacrylic esters or acrylic esters either singly or in combination of two or more monomers thereof are particularly preferred.

When the macromonomer is used, it is used in a proportion of generally 0.01 to 1 part by weight, preferably 0.03 to 0.8 parts by weight per 100 parts by weight of the polymerizable monomer.

(9) Colorant:

As examples of black colorants, may be mentioned dyes and pigment such as carbon black and Nigrosine Base; and magnetic powders such as cobalt, nickel, triiron tetroxide, manganese iron oxide, zinc iron oxide and nickel iron oxide. When carbon black is used as a colorant, that having a primary particle diameter of 20 to 40 nm is preferably used in that the resulting toner can provide images good in image quality, and the safety of the toner in environment is enhanced.

Examples of colorants for color toners include Nahthol Yellow S, Hansa Yellow G, C.I. Pigment Yellow, C.I. Vat Yellow, eosine lake, C.I. Pigment Red, C.I. Pigment Violet, C.I. Vat Red, Phthalocyanine Blue, C.I. Pigment Blue, C.I. Vat Blue and C.I. Acid Blue.

These colorants are used in a proportion of generally 0.1 to 50 parts by weight, preferably 1 to 20 parts by weight per 100 parts by weight of the vinyl monomer.

(10) Dispersion Stabilizer:

The dispersion stabilizer used in the present invention is preferably that containing colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Among these, the dispersing agents containing the colloid of a hardly water-soluble metal hydroxide are preferred because the particle diameter distribution of the resulting polymer particles can be narrowed, and the brightness or sharpness of an image formed from such a polymerized toner is enhanced.

The dispersing agent containing the colloid of the hardly water-soluble metal hydroxide is not limited by the production process thereof. However, it is preferred to use colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase.

The colloid of the hardly water-soluble metal hydroxide used in the present invention preferably has number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m.

The dispersing agent is generally used in a proportion of 0.1 to 20 parts by weight per 100 parts by weight of the polymerizable monomer. If the proportion of the dispersing agent used is lower then 0.1 parts by weight, it is difficult to achieve sufficient dispersion stability, so that the resulting polymer tends to aggregate. If the proportion of the dispersing agent used exceeds 20 parts by weight on the other hand, the viscosity of the resulting dispersion becomes too high, and polymerization stability is lowered.

In the present invention, a dispersing agent containing a water-soluble polymer may be used as needed. As examples of the water-soluble polymer, may be mentioned polyvinyl alcohol, methyl cellulose and gelatin. In the present invention, there is no need to use any surfactant. However, a surfactant may be used for the purpose of stably conducting the suspension polymerization so far as the dependence of the charge properties of the resulting polymerized toner on environment does not become high.

A polymerized toner having a volume average particle diameter of generally 1 to 12 $\mu$m, preferably 3 to 10 $\mu$m, particularly preferably 4 to 8 $\mu$m and a ratio of volume average particle diameter (dv)/number average particle diameter (dp) of generally at most 1.7, preferably at most 1.5, more preferably at most 1.4 can be obtained by the production process of a toner according to the present invention. Any polymerized toner having a volume average particle diameter smaller than 1 $\mu$Mm is difficult to produce. If the particle diameter is greater than 12 $\mu$m, the resolution of images formed with such a toner may be lowered in some cases. If the particle diameter distribution is greater than 1.7, coarse particles of a toner tend to form in plenty, and so the resolution of images formed with such a toner may be lowered in some cases.

2-3. Toner of core-shell structure:

The toner (capsule toner) having a core-shell structure is preferably produced by the polymerization process.

(1) Production Process of Toner of Core-shell Structure:

In the capsule toner, polymerized toner particles (colored polymer particles) prepared by using polymerizable monomer(s) selected so as to give a composition of a polymer having a glass transition temperature (Tg) of generally at most 60° C., preferably 40 to 60° C. in accordance with the above-described process are used as core particles. The toner of the core-shell structure according to the present invention is obtained by adding a monomer for shell to the reaction system in the presence of the core particles and polymerizing it. In the toner of the core-shell structure, the monomer for core and the monomer for shell are used in proportions of 80 to 99.6 wt. % and 0.1 to 20 wt. %, respectively.

The monomer for shell used in the present invention must be preset in such a manner that the glass transition temperature of a polymer formed from the monomer for shell is higher than the glass transition temperature of a polymer formed from the monomer for core. In order to improve the shelf stability of the resulting toner of the core-shell structure, the glass transition temperature of the polymer formed from the monomer for shell is generally higher than 50° C., but not higher than 120° C., preferably higher than 60° C., but not higher than 110° C., more preferably higher than 80° C., but not higher than 105° C.

A difference in glass transition temperature between the polymer formed from the monomer for core and the polymer formed from the monomer for shell is generally at least 10° C., preferably at least 20° C., more preferably at least 30° C.

When the monomer for shell is polymerized in the presence of the core particles, it is desirably formed into droplets smaller than the number average particle diameter of the core particles. If the droplet diameter of the droplets of the monomer for shell is too great, the shell (polymer layer) cannot be caused to uniformly adhere to the core particles, and so the resulting toner shows a tendency to lower its shelf stability. In order to form the monomer for shell into fine droplets, a mixture of the monomer for shell and an aqueous dispersion medium is subjected to a finely dispersing treatment by means of, for example, an ultrasonic emulsifier. It is preferred that the aqueous dispersion thus obtained be added to the reaction system in which the core particles are present.

The monomer for shell is not particularly limited by solubility in water at 20° C. However, a relatively water-soluble monomer having a solubility of at least 0.1 wt. % in water at 20° C. is liable to quickly migrate to the surfaces of the core particles, so that polymer particles having good shelf stability are easy to obtain.

On the other hand, when a monomer having a solubility lower than 0.1 wt. % in water at 20° C. is used as a monomer for shell, its migration to the surfaces of the core particles becomes slow. Therefore, it is preferred that such a monomer be formed into droplets smaller than the core particles and then polymerized as described above. Even when a monomer for shell having a solubility lower than 0.1 wt. % in water at 20° C. is used, the monomer for shell becomes easy to quickly migrate to the surfaces of the core particles when an organic solvent having a solubility of at least 5 wt. % in water at 20° C. is added to the reaction system, so that polymer particles having good shelf stability are easy to obtain.

Examples of the monomer having a solubility of at least 0.1 wt. % in water at 20° C. include (meth)acrylic esters such as methyl methacrylate and methyl acrylate; amides such as acrylamide and methacrylamide; vinyl cyanide compounds such as acrylonitrile and methacrylonitrile; nitrogen-containing vinyl compounds such as 4-vinylpyridine; and vinyl acetate and acrolein.

On the other hand, examples of the monomer for shell having a solubility lower than 0.1 wt. % in water at 20° C. include styrene, butyl acrylate, 2-ethylhexyl acrylate, ethylene and propylene.

As examples of a specific process for polymerizing the monomer for shell in the presence of the core particles, may be mentioned a process in which the monomer for shell is added to the reaction system of the polymerization reaction which has been conducted for obtaining the core particles, thereby continuously conducting polymerization, and a process in which the core particles obtained in a separate reaction system are charged, to which the monomer for shell is added, thereby conducting polymerization stepwise.

The monomer for shell may be added to the reaction system in one lot, or continuously or intermittently by means of a pump such as a plunger pump.

(2) Water-soluble Radical Polymerization Initiator:

In the present invention, it is preferable to add a water-soluble radical polymerization initiator to the reaction system at the time the monomer for shell is added because particles of a core-shell structure are easy to provide. It is considered that when the water-soluble radical polymerization initiator is added upon the addition of the monomer for shell, the water-soluble polymerization initiator enters in the vicinity of each surface of the core particles to which the monomer for shell has migrated, so that a polymer layer is easy to form on the core particle surface.

As examples of the water-soluble radical polymerization initiator, may be mentioned persulfates such as potassium persulfate and ammonium persulfate; azo initiators such as 4,4'-azobis(4-cyanovaleric acid), 2,2'-azobis(2-amidinopropane) bihydrochloride and 2,2'-azobis-2-methyl-N-1,1'-bis(hydroxymethyl)-2-hydroxyethylpropionamide; and combinations of an oil-soluble initiator such as cumene peroxide with a redox catalyst. The amount of the water-soluble radical polymerization initiator used is generally 0.1 to 20 wt. % based on the monomer for shell.

(3) Properties of Toner of Core-shell Structure:

The toner of the core-shell structure according to the present invention is generally produced by using 80 to 99.9 wt. % of a monomer for core (monomer forming core particles) and to 0.1 wt. % of a monomer for shell. If the proportion of the monomer for shell is too low, the effect of improving the shelf stability becomes little. If the proportion is too high on the other hand, the effect of lowering the fixing temperature becomes little.

A polymerized toner having a volume average particle diameter of generally 1 to 12 μm, preferably 3 to 10 μm, particularly preferably 4 to 8 μm and a ratio of volume average particle diameter (dv)/number average particle diameter (dp) of generally at most 1.7, preferably at most 1.5, more preferably at most 1.3 can be obtained by the production process of a toner according to the present invention. Any polymerized toner having a volume average particle diameter smaller than 1 μm is difficult to produce. If the particle diameter is greater than 12 μm, the resolution of images formed with such a toner may be lowered in some cases.

The particle diameter distribution (volume average particle diameter/number average particle diameter) of the toner is generally at most 1.7, preferably at most 1.5, more preferably at most 1.4. If the particle diameter distribution is greater than 1.7, coarse particles of a toner tend to form in plenty, and so the resolution of images formed with such a toner may be lowered in some cases.

The average thickness of the shell in the toner of the core-shell structure is generally 0.001 to 1 μm, preferably 0.002 to 0.5 μm, more preferably 0.003 to 0.1 μm. If the thickness of the shell is smaller than 0.001 μm, the shelf stability of the toner is deteriorated. If the thickness is greater than 1 μm, the fixing ability of the toner is deteriorated. Incidentally, in the core-shell structure, there is no need to cover the whole core part with the shell.

The particle diameters of the core particles and the thickness of the shell can be determined by directly measuring the size and shell thickness of each of particles selected at random from electron photomicrographs thereof when they can be observed through an electron microscope. If the core and the shell are difficult to observe through the electron microscope, the thickness of the shell can be calculated out from the particle diameter of the core particles and the amount of the monomer for forming the shell.

3. Developer:

The developer according to the present invention is prepared from the above-described toner and external additives in accordance with a method known per se in the art.

(1) External Additives:

Examples of the external additives include inorganic particles and organic resin particles. Examples of the inorganic particles include particles of silicon dioxide, aluminum oxide, titanium oxide, zinc oxide, tin oxide, barium titanate, aluminum silicate and strontium titanate. Examples of the organic resin particles include particles of methacrylic ester polymers, acrylic ester polymers, styrene-methacrylic ester copolymers and styrene-acrylic ester copolymers, core-shell type particles in which the core is composed of a methacrylic ester polymer, and the shell is composed of a styrene polymer, and core-shell type particles in which the core is composed of a styrene polymer, and the shell is composed of a methacrylic ester polymer.

Of these, the particles of the inorganic oxides, particularly, silicon dioxide particles are preferred. The surfaces of these particles can be subjected to a hydrophobicity-imparting treatment, and silicon dioxide particles subjected to the hydrophobicity-imparting treatment are particularly preferred. No particular limitation is imposed on the amount of the external additives used. However, it is generally about 0.1 to 6 parts by weight per 100 parts by weight of the toner particles.

Two or more of the external additives may be used in combination. When the external additives are used in combination, it is preferable to use two or more kinds of inorganic oxide particles or organic resin particles different in average particle diameter from each other in combination.

The adhesion of the external additives to the toner particles is generally conducted by charging them into a mixer such as a Henschel mixer to mix them under stirring.

EXAMPLES

The present invention will hereinafter be described more specifically by the following Examples and Comparative Examples. All designations of "part" or "parts" and "%" as will be used in the following examples mean part or parts by weight and wt. % unless expressly noted.

Various properties in the following Examples and Comparative Examples were evaluated in accordance with the following respective methods.

1. Properties of Toner:

(1) Spheroidicity:

An electron microphotograph of a toner sample was taken, and a ratio (rl/rs) of a length rl to a breadth rs thereof was calculated out about 100 particles per sample t o calculate an average value thereof.

(2) Particle Diameter:

The volume average particle diameter (dv) and particle diameter distribution, i.e., a ratio (dv/dp) of volume average particle diameter to number average particle diameter (dp) of a polymer particle sample were measured by means of a Multisizer (manufactured by Coulter Co.). The measurement by the Multisizer was conducted under the following conditions:

aperture diameter: 100 $\mu$m;

medium: Isothone II, concentration: 10%; and number of particles measured: 50,000 particles.

(3) Thickness of shell:

In the examples of the present invention, the thickness of shell in each toner sample was calculated out in the following equation, since the thickness of the shell was thin though it can be measured by the Multisizer or through an electron microscope where the thickness of the shell is great.

$$x=r(1+s/100)^{1/3}-r \quad (1)$$

wherein r: the radius of core particles before addition of a monomer for shell (a half of the volume average particle diameter of the core particles found from measurement by the Multisizer; $\mu$m);

x: the thickness ($\mu$m) of shell;

s: the number of parts of the monomer for shell added (the number of parts per 100 parts by weight of a monomer for core).

In this measurement, the density $\rho$ (g/cm$^3$) of a resin forming the shell is regarded as 1.0.

2. Properties of Developer:

(1) Fixing Temperature:

A commercially available printer (4 papers per minute printer) of a non-magnetic one-component development system was modified in such a manner that the temperature of a fixing roll can be varied. This modified printer was used to conduct a fixing test. However, in Examples 12 to 15, a commercially available printer (8 papers per minute printer) of a non-magnetic one-component development system which had been modified in such a manner that the temperature of a fixing roll can be varied was used to conduct the fixing test (the same shall apply to the following tests on environmental dependence and durability). The fixing test was carried out by varying the temperature of the fixing roll in the modified printer to determine the fixing rate at each temperature, thereby finding a relationship between the temperature and the fixing rate.

The fixing rate was calculated from the ratio of image densities before and after a peeling operation using an adhesive tape, which was conducted against a black solid printed area of a test paper sheet, on which printing had been made by the modified printer. More specifically, assuming that the image density before the peeling of the adhesive tape is $ID_{before}$, and the image density after the peeling of the adhesive tape is $ID_{after}$, the fixing rate can be calculated out from the following equation:

$$\text{Fixing rate } (\%)=(ID_{after}/ID_{before})\times 100$$

The peeling operation of the adhesive tape is a series of operation that a pressure-sensitive adhesive tape (Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co.

In this fixing test, a temperature of the fixing roll at which a fixing rate of the developer amounted to 80% was defined as a fixing temperature of the developer.

(2) Offset Temperature:

Black solid printing was conducted by varying a fixing temperature like the fixing temperature test to define a temperature of the fixing roll at which offset occurred as an offset temperature.

(3) Shelf Stability:

Each developer sample was placed in a closed container to seal it, and the container was sunk into a constant-temperature water bath controlled to 55° C. The container was taken out of the constant-temperature water bath after 8 hours had elapsed, and the developer contained in the container was transferred to a 42-mesh sieve. At this time, the developer was quietly taken out of the container so as not to destroy the aggregate structure of the developer in the container, and carefully transferred to the sieve. The sieve was vibrated for 30 seconds by means of a powder measuring device (Powder Tester; manufactured by Hosokawa Micron Corporation) under conditions of vibration intensity of 4.5. The weight of the developer remaining on the sieve was then measured to regard it as the weight of the developer aggregated. A proportion (wt. %) by weight of the aggregated developer to the weight of the developer first put into the container was calculated out. The measurement was conducted 3 times on one sample to use the average value thereof as an index to the shelf stability.

(4) Dependence of Image Quality on Environment:

Printing was continuously conducted from the beginning by means of the above-described modified printer under (H/H) environment of 35° C. in temperature and 80% in RH (relative humidity) and (L/L) environment of 10° C. in temperature and 20% in RH to count the number of printed sheets that continuously retained an image density of 1.3 or higher as measured by a reflection densitometer (manufactured by McBeth Co.) and at an unprinted area, fog of 10% or lower as measured by a whiteness meter (manufactured by Nippon Denshoku K.K.), thereby evaluating a developer sample as to the dependence of image quality on environment in accordance with the following standard:

○: the number of the printed sheets that continuously retained the above-described image quality was 10,000 or more;

Δ: the number of the printed sheets that continuously retained the above-described image quality was not less than 5,000, but less than 10,000; and ×: the number of the printed sheets that continuously retained the above-described image quality was less than 5,000.

(5) Durability:

Printing was continuously conducted from the beginning by means of the above-described modified printer under room-temperature environment of 23° C. and 50% RH to count the number of printed sheets that continuously retained an image density of 1.3 or higher as measured by a reflection densitometer (manufactured by McBeth Co.) and at an unprinted area, fog of 10% or lower as measured by a whiteness meter (manufactured by Nippon Denshoku K.K.), thereby evaluating the developer sample as to the durability of image quality in accordance with the following standard:

○: the number of the printed sheets that continuously retained the above-described image quality was 10,000 or more;

Δ: the number of the printed sheets that continuously retained the above-described image quality was not less than 5,000, but less than 10,000; and ×: the number of the printed sheets that continuously retained the above-described image quality was less than 5,000.

6) Volume Resistivity:

The volume resistivity of each toner sample was measured by means of a dielectric loss measuring device (TRS-10 Model, trade name; manufactured by Ando Electric Co., Ltd.) under conditions of a temperature of 30° C. and a frequency of 1 kHz.

(7) Resolution:

A one-dot line and a one-dot white line were printed to visually observe whether their image qualities were reproduced or not through a light microscope, thereby evaluating each developer sample as to resolution in accordance with the following standard:

○:the one-dot line and the one-dot white line were reproduced;

Δ: the one-dot line and the one-dot white line were not reproduced, but a two-dot line and a two-dot white line were reproduced; and ×: even the two-dot line and the two-dot white line were not reproduced.

(8) Flowability:

Three kinds of sieves having sieve openings of 150, 75 and 45 μm, respectively, are laid on top of another in that order from above, and a developer (4 g) to be measured was precisely weighed and put on the uppermost sieve. The three kinds of sieves are then vibrated for 15 seconds by means of a powder measuring device ("REOSTAT", trade name; Powder Tester; manufactured by Hosokawa Micron Corporation) under conditions of vibration intensity of 4. Thereafter, the weight of the developer captured on each sieve was measured and substituted into its corresponding equation ①, ② or ③ shown below, thereby calculating out a value of flowability. The measurement was conducted 3 times on one sample to find an average value thereof.

Numerical Expressions:

① a=[weight (g) of the developer remaining on the sieve of 150 μm]/4 g×100

② b=[weight (g) of the developer remaining on the sieve of 75 μm]/4 g×100×0.6

③ c=[weight (g) of the developer remaining on the sieve of 45 μm]/4 g×100×0.2

Flowability (%)=100−(a+b+c)

3. Dispersibility of Colorant:

A monomer, a colorant sample, a polar resin and other additives were mixed and uniformly dispersed by means of a media type grinding machine, and the resultant liquid mixture was visually observed through a light microscope to evaluate of the dispersibility of the colorant in accordance with the following standard:

○: successfully dispersed;

Δ: slightly dispersed; and

×: scarcely disperse.

Example 1

(1) Synthesis of Polar Resin:

A 3-liter flask was charged with 900 parts of toluene, 87 parts of styrene, 10 parts of butyl acrylate, 3 parts of 2-acrylamido-2-methylpropanesulfonic acid and 2 parts of azobisdimethylvaleronitrile, and the resultant mixture was stirred to conduct a reaction at 90° C. for 8 hours. The solvent was then removed by distillation under reduced pressure to obtain a sulfonic group-containing copolymer having Mw of 21,000. The Tg of this polar resin is 78° C.

(2) Grinding of Parting Agent:

Ninety parts of styrene and 10 parts of a parting agent ("FT-100", trade name; natural gas type Fischer-Tropsch wax produced by Shell MDS Co.) were wet-ground by means of a media type wet grinding machine to prepare a styrene monomer-parting agent dispersion, in which the parting agent had been uniformly dispersed in styrene. The volume average particle diameter of the parting agent in this dispersion was 2.8 μm in terms of $D_{50}$ and 6.5 μm in terms of $D_{90}$. The solids content in this dispersion was 10.0%.

(3) Preparation of Polymerized Core Particles:

Twenty parts (styrene content: 18 parts) of the parting agent dispersion obtained in the step (2), 62.5 parts of styrene, 19.5 parts of n-butyl acrylate, 7 parts of carbon black ("#25B", trade name; primary particle diameter: 40 nm; product of Mitsubishi Kagaku Co., Lt.), 1 part of 2-acrylamido-2-methylpropanesulfonic acid-containing copolymer (Mw=21,000, styrene unit=87%, n-butyl acrylate unit 10%, 2-acrylamido-2-methylpropanesulfonic acid unit=3%) and 0.3 parts of divinylbenzene were stirred and mixed by an ordinary stirring device and then uniformly dispersed by a media type dispersing machine, thereby obtaining a monomer composition (liquid mixture) for core.

On the other hand, an aqueous solution with 5.8 parts of sodium hydroxide (alkali metal hydroxide) dissolved in 50 parts of ion-exchanged water was gradually added to an aqueous solution with 9.5 parts of magnesium chloride (water-soluble polyvalent metallic salt) dissolved in 250 parts of ion-exchanged water under stirring to prepare a dispersion of magnesium hydroxide colloid (colloid of hardly water-soluble metal hydroxide). The particle diameter distribution of the colloid formed was measured by means of a microtrack particle diameter distribution measuring device (manufactured by Nikkiso Co., Ltd.) and found to be 0.36 μm in terms of $D_{50}$ (50% cumulative value of number particle diameter distribution) and 0.80 μm in terms of $D_{90}$ (90% cumulative value of number particle diameter distribution). The measurement by means of the microtrack particle diameter distribution measuring device was performed under the following conditions:

measuring range: 0.12 to 704 μm;

measuring time: 30 seconds; and medium: ion-exchanged water.

The monomer composition was poured into the colloidal dispersion of magnesium hydroxide obtained above, the mixture was stirred until droplets became stable, and 6 parts of t-butyl peroxy-2-ethylhexanoate was then added as a polymerization initiator. The resultant monomer mixture was stirred 30 minutes at 15,000 rpm under high shearing force by means of an Ebara Milder to form fine droplets of the monomer mixture. The thus-prepared aqueous dispersion containing droplets of the monomer mixture was charged into a 10-L reactor equipped with an agitating blade to initiate a polymerization reaction at 90° C. At the time the conversion of the monomer into a polymer reached almost 100%, sampling was conducted to measure the particle diameter of core particles formed. As a result, the particle diameter of the core particles was found to be 7.0 μm.

(4) Formation of Shell:

Three parts of methyl methacrylate (calculated Tg of the resulting polymer=105° C.) and 100 parts of water were subjected to a finely dispersing treatment by an ultrasonic emulsifier, thereby obtaining an aqueous dispersion of a monomer for shell. The droplet diameter of droplets of the monomer for shell was found to be 1.6 μm in terms of $D_{90}$ as determined by means of a microtrack particle diameter distribution measuring device by adding the droplets at a concentration of 3% to a 1% aqueous solution of sodium hexametaphosphate.

The reactor was charged with the aqueous dispersion of the monomer for shell and a solution with 0.3 parts of a water-soluble polymerization initiator [2,2'-azobis(2-methyl-N-(2-hydroxyethyl)-propionamide)] dissolved in 65 parts of distilled water. After the reaction was continued for 8 hours, the reaction was stopped to obtain an aqueous dispersion of toner particles having a pH of 9.5.

While stirring the aqueous dispersion of toner particles obtained above, the pH of the system was adjusted to about 5.5 with sulfuric acid to conduct acid washing (at 25° C. for 10 minutes). The thus-treated dispersion was then filtered and dehydrated. After the dehydration, washing water was sprayed on the residue to conduct water washing. Thereafter, the thus-treated residue was dried for 2 days by a dryer (at 45° C.) to obtain toner particles (capsule toner) of a core-shell structure. The toner particles had a spheroidicity of 1.17 and a volume average particle diameter of 7.1 μm.

(5) Preparation of Developer:

To 100 parts of the toner particles obtained above were added 0.8 parts of silica ("R202", trade name; product of Degussa AG) having an average particle diameter of 14 nm subjected to a hydrophobicity-imparting treatment, and they were mixed by means of a Henschel mixer to prepare a non-magnetic one-component developer.

The properties of the developer obtained in accordance with the above formulation were evaluated. The evaluation of image revealed that at both high temperature and high humidity, and low temperature and low humidity, extremely good images good in color tone, high in image density and free of fog were obtained. The evaluation results are shown in Table 1.

Example 2

A sulfonic group-containing polymer having Mw of 17,000 was obtained in the same manner as in Example 1 except that in the synthesis of the polar resin in Example 1, the amount of azobisisobutyronitrile was increased from 2 parts to 2.5 parts, and the polymerization temperature was raised from 90° C. to 95° C. Thereafter, a capsule toner was prepared in the same manner as in Example 1 and evaluated. As a result, the evaluation of image revealed that at both high temperature and high humidity, and low temperature and low humidity, extremely good images good in color tone, high in image density and free of fog were obtained. The evaluation results are shown in Table 1.

Example 3

A sulfonic group-containing polymer having Mw of 25,000 was obtained in the same manner as in Example 1 except that in the synthesis of the polar resin in Example 1, the amount of azobisisobutyronitrile was decreased from 2 parts to 1 part, and the polymerization temperature was lowered from 90° C. to 85° C. Thereafter, a capsule toner was prepared in the same manner as in Example 1 and evaluated. As a result, the evaluation of image revealed that at both high temperature and high humidity, and low temperature and low humidity, extremely good images good in color tone, high in image density and free of fog were obtained. The evaluation results are shown in Table 1.

Comparative Example 1

A sulfonic group-containing polymer having Mw of 15,000 was obtained in the same manner as in Example 1 except that in the synthesis of the polar resin in Example 1, the amount of azobisisobutyronitrile was increased from 2 parts to 3 parts, and the polymerization temperature was raised from 90° C. to 95° C. Thereafter, a capsule toner was prepared in the same manner as in Example 1 and evaluated. As a result, images which had fog to a great extent at high temperature and high humidity in the evaluation of image, and were insufficient in the evaluation of durability were obtained. The evaluation results are shown in Table 1.

TABLE 1

| | Example | | | Comp. Example |
|---|---|---|---|---|
| | 1 | 2 | 3 | 1 |
| Polar resin: | | | | |
| Amount of functional group (%) (Note) | 3 | 3 | 3 | 3 |
| Weight average molecular weight | $2.1 \times 10^4$ | $1.7 \times 10^4$ | $2.5 \times 10^4$ | $1.5 \times 10^4$ |
| Amount added (part) | 1 | 1 | 1 | 1 |
| Toner: | | | | |
| Spheroidicity | 1.17 | 1.15 | 1.18 | 1.23 |
| Particle diameter of core (μm) | 7.0 | 7.1 | 7.1 | 6.9 |
| Thickness of shell (μm) | 0.03 | 0.04 | 0.04 | 0.03 |
| Volume average particle diameter (μm) | 7.1 | 7.2 | 7.2 | 7.0 |
| Particle diameter distribution (dv/dp) | 1.24 | 1.29 | 1.22 | 1.41 |
| Developer: | | | | |
| Fixing temperature (° C.) | 130 | 130 | 130 | 125 |
| Offset temperature (° C.) | 180 | 190 | 190 | 180 |
| Glass transition temperature (° C.) | 55 | 56 | 56 | 55 |
| Shelf stability (%) | 1 | 2 | 4 | 15 |
| Electrical resistance (logΩ/cm) | 11.3 | 11.2 | 11.3 | 11.1 |
| Environmental dependence of image quality: | | | | |
| (H/H) | ○ | ○ | ○ | Δ |
| (L/L) | ○ | ○ | ○ | ○ |
| Durability | ○ | ○ | ○ | Δ |

(Note)
Amount of functional group: a proportion of the 2-acrylamido-2-methylpropanesulfonic acid unit in the copolymer (the same shall apply hereinafter).

Example 4

A capsule toner was obtained in the same manner as in Example 1 except that in the synthesis of the polar resin in Example 1, the amounts of Styrene and 2-acrylamido-2-methylpropanesulfonic acid were changed to 84 parts and 6 parts, respectively, and evaluated similarly to Example 1. As a result, the evaluation of image revealed that at both high temperature and high humidity, and low temperature and low humidity, extremely good images good in color tone, high in image density and free of fog were obtained. The evaluation results are shown in Table 2. Incidentally, the Tg of the polar resin is 80° C.

Example 5

A capsule toner was obtained in the same manner as in Example 1 except that in the synthesis of the polar resin in Example 1, the amounts of Styrene and 2-acrylamido-2-methylpropanesulfonic acid were changed to 89 parts and 1 part, respectively, and evaluated similarly to Example 1. As a result, the evaluation of image revealed that at both high temperature and high humidity, and low temperature and low humidity, extremely good images good in color tone, high in image density and free of fog were obtained. The evaluation results are shown in Table 2. Incidentally, the Tg of the polar resin is 76° C.

Example 6

A capsule toner was obtained in the same manner as in Example 1 except that the amount of the polar resin added in Example 1 was increased from 1 part to 5 parts, and evaluated similarly to Example 1. As a result, the evaluation of image revealed that at both high temperature and high humidity, and low temperature and low humidity, extremely good images good in color tone, high in image density and free of fog were obtained. The evaluation results are shown in Table 2.

Example 7

A capsule toner was obtained in the same manner as in Example 1 except that the amount of the polar resin added in Example 1 was decreased from 1 part to 0.5 parts, and evaluated similarly to Example 1. As a result, the evaluation of image revealed that at both high temperature and high humidity, and low temperature and low humidity, extremely good images good in color tone, high in image density and free of fog were obtained. The evaluation results are shown in Table 2.

TABLE 2

| | Example | | | |
|---|---|---|---|---|
| | 4 | 5 | 6 | 7 |
| Polar resin: | | | | |
| Amount of functional group (%) | 6 | 1 | 3 | 3 |
| Weight average molecular weight | $2.1 \times 10^4$ | $2.1 \times 10^4$ | $2.1 \times 10^4$ | $2.1 \times 10^4$ |
| Amount added (part) | 1 | 1 | 5 | 0.5 |
| Toner: | | | | |
| Spheroidicity | 1.18 | 1.16 | 1.16 | 1.15 |
| Particle diameter of core (μm) | 7.0 | 7.1 | 7.0 | 7.1 |
| Thickness of shell (μm) | 0.03 | 0.04 | 0.03 | 0.04 |
| Volume average particle diameter (μm) | 7.1 | 7.2 | 7.1 | 7.2 |
| Particle diameter distribution (dv/dp) | 1.23 | 1.28 | 1.28 | 1.22 |
| Developer: | | | | |
| Fixing temperature (° C.) | 130 | 135 | 130 | 125 |
| Offset temperature (° C.) | 190 | 180 | 190 | 180 |
| Glass transition temperature (° C.) | 56 | 56 | 56 | 56 |
| Shelf stability (%) | 4 | 6 | 4 | 2 |
| Electrical resistance (logΩ/cm) | 11.3 | 11.2 | 11.3 | 11.4 |

TABLE 2-continued

| | Example | | | |
|---|---|---|---|---|
| | 4 | 5 | 6 | 7 |
| Environmental dependence of image quality: | | | | |
| (H/H) | ○ | ○ | ○ | ○ |
| (L/L) | ○ | ○ | ○ | ○ |
| Durability | ○ | ○ | ○ | ○ |

Comparative Example 2

It was attempted to prepare a capsule toner in the same manner as in Example 1 except that in the synthesis of the polar resin in Example 1, the amounts of Styrene and 2-acrylamido-2-methylpropanesulfonic acid were changed to 78 parts and 12 parts, respectively. However, droplets formed had an unstable particle diameter and underwent phase inversion, resulting in a failure to polymerize.

Comparative Example 3

A capsule toner was obtained in the same manner as in Example 1 except that in the synthesis of the polar resin in Example 1, the amounts of Styrene and 2-acrylamido-2-methylpropanesulfonic acid were changed to 89.95 parts and 0.05 parts, respectively, and evaluated similarly to Example 1. As a result, the resultant developer was charged only at a low level, and images formed therefrom had fog to a great extent and were insufficient in image quality. The evaluation results are shown in Table 3.

TABLE 3

| | Comparative Example | |
|---|---|---|
| | 2 | 3 |
| Polar resin: | | |
| Amount of functional group (%) | 12 | 0.05 |
| Weight average molecular weight | $2.1 \times 10^4$ | $2.1 \times 10^4$ |
| Amount added (part) | 1 | 1 |
| Toner: | Failed to polymerize | |
| Spheroidicity | — | 1.36 |
| Particle diameter of core (μm) | — | 7.1 |
| Thickness of shell (μm) | — | 0.04 |
| Volume average particle diameter (μm) | — | 7.2 |
| Particle diameter distribution (dv/dp) | — | 1.56 |
| Developer: | | |
| Fixing temperature (° C.) | — | 135 |
| Offset temperature (° C.) | — | 180 |
| Glass transition temperature (° C.) | — | 56 |
| Shelf stability (%) | — | 25 |
| Electrical resistance (logΩ/cm) | — | 11.0 |
| Environmental dependence of image quality: | | |
| (H/H) | — | X |
| (L/L) | — | X |
| Durability | — | X |

From the results described above, it is understood that a toner which has excellent fixing properties, offset resistance and shelf stability and can provide images excellent in image quality can be obtained by specifying the molecular weight of the polar resin and the content of the sulfonic group-containing (meth)acrylamide in the polar resin.

Example 8

(1) Synthesis of Polar Resin:

A 3-liter flask was charged with 900 parts of toluene, 87 parts of styrene, 10 parts of butyl acrylate, 3 parts of 2-acrylamido-2-methylpropanesulfonic acid and 2 parts of azobisdimethylvaleronitrile, and the resultant mixture was stirred to conduct a reaction at 90° C. for 8 hours. The solvent was then removed by distillation under reduced pressure to obtain a polar resin (A) having a weight average molecular weight (Mw) of 21,000. The Tg of this polar resin is 78° C.

(2) Production of Toner:

A monomer component composed of 83 parts of styrene and 17 parts of n-butyl acrylate, 5 parts of a yellow pigment ("Toner Yellow HG VP2155", trade name; product of Clariant Co.) and 1 part of the polar resin (A) were stirred and mixed by an ordinary stirring apparatus and then uniformly dispersed by a media type dispersing machine. Four parts of pentaerythritol tetramyristate were added to and mixed with the resultant mixture into a solution, thereby obtaining a polymerizable monomer composition.

On the other hand, an aqueous solution with 5.8 parts of sodium hydroxide (alkali metal hydroxide) dissolved in 50 parts of ion-exchanged water was gradually added to an aqueous solution with 9.5 parts of magnesium chloride (water-soluble polyvalent metallic salt) dissolved in 250 parts of ion-exchanged water under stirring to prepare a dispersion of magnesium hydroxide colloid (colloid of hardly water-soluble metal hydroxide). The particle diameter distribution of the colloid formed was measured by means of a microtrack particle diameter distribution measuring device (manufactured by Nikkiso Co., Ltd.) and found to be 0.36 $\mu$m in terms of $D_{50}$ (50% cumulative value of number particle diameter distribution) and 0.80 $\mu$m in terms of $D_{90}$ (90t cumulative value of number particle diameter distribution). The measurement by means of the microtrack particle diameter distribution measuring device was performed under the following conditions:

measuring range: 0.12 to 704 $\mu$m;

measuring time: 30 seconds; and medium: ion-exchanged water.

The polymerizable monomer composition was poured into the colloidal dispersion of magnesium hydroxide obtained above, the mixture was stirred until droplets became stable, and 6 parts of t-butyl peroxy-2-ethylhexanoate was then added as a polymerization initiator. The resultant monomer mixture was stirred 30 minutes at 15,000 rpm under high shearing force by means of an Ebara Milder ("MDN303 V Model", manufactured by Ebara Corporation) to form fine droplets of the monomer mixture. The thus-prepared aqueous dispersion containing droplets of the monomer mixture was charged into a 10-L reactor equipped with an agitating blade to initiate a polymerization reaction at 90° C. After the reaction was continuously conducted for 8 hours, the reaction was stopped to obtain an aqueous dispersion of polymer particles having a pH of 9.5.

While stirring the above-obtained aqueous dispersion of the polymer particles, the pH of the system was adjusted to about 5.5 with sulfuric acid to conduct acid washing (25° C., 10 minutes). Filtration and hydration were then conducted, and washing water was sprayed on the residue after the dehydration to conduct water washing. Thereafter, the thus-treated residue was dried for 2 days by a dryer (at 45° C.) to obtain toner particles having a volume average particle diameter (dv) of 6.7 $\mu$m.

(3) Preparation of Developer:

To 100 parts of the toner particles obtained above were added 0.8 parts of silica ("R202", trade name; product of Degussa AG) having an average particle diameter of 14 nm subjected to a hydrophobicity-imparting treatment, and they were mixed by means of a Henschel mixer to prepare a non-magnetic one-component developer (yellow toner).

The properties of the developer thus obtained were evaluated. The evaluation revealed that at both high temperature and high humidity, and low temperature and low humidity, extremely good images good in color tone, high in image density and free of fog were obtained. The evaluation results are shown in Table 4.

Example 9

Synthesis was conducted in the same manner as in Example 8 except that in the synthesis of the polar resin in Example 8, the amount of azobisisobutyronitrile as the polymerization initiator was increased from 2 parts to 2.5 parts, and the polymerization temperature was raised from 90° C. to 95° C., thereby obtaining a polar resin (B) having Mw of 17,000.

A magenta toner was obtained in the same manner as in Example 8 except that the yellow pigment in Example 8 was changed to a magenta pigment ("Toner Magenta E-02", product of Clariant Co).

A developer was prepared in the same manner as in Example 8 and evaluated. The evaluation revealed that at both high temperature and high humidity, and low temperature and low humidity, extremely good images good in color tone, high in image density and free of fog were obtained. The evaluation results are shown in Table 4.

Example 10

Synthesis was conducted in the same manner as in Example 8 except that in the synthesis of the polar resin in Example 8, the amount of azobisisobutyronitrile as the polymerization initiator was decreased from 2 parts to 1 part, and the polymerization temperature was lowered from 90° C. to 85° C., thereby obtaining a polar resin (C) having Mw of 25,000.

A cyan toner was obtained in the same manner as in Example 8 except that the yellow pigment in Example 8 was changed to a cyan pigment ("GN-X", product of Sumika Color Co., Ltd.).

A developer was prepared in the same manner as in Example 8 and evaluated. The evaluation revealed that at both high temperature and high humidity, and low temperature and low humidity, extremely good images good in color tone, high in image density and free of fog were obtained. The evaluation results are shown in Table 4.

Example 11

Synthesis was conducted in the same manner as in Example 8 except that in the synthesis of the polar resin in Example 8, the amounts of styrene and 2-acrylamido-2-methylpropanesulfonic acid were changed to 89 parts and 1 part, respectively, thereby obtaining a polar resin (D). The Tg of this polar resin is 76° C.

A black toner was obtained in the same manner as in Example 8 except that the yellow pigment in Example 8 was changed to carbon black ("#25B", trade name; primary particle diameter: 40 nm; product of Mitsubishi Kagaku Co., Lt.).

A developer was prepared in the same manner as in Example 8 and evaluated. The evaluation revealed that at both high temperature and high humidity, and low temperature and low humidity, extremely good images good in color tone, high in image density and free of fog were obtained. The evaluation results are shown in Table 4.

Comparative Example 4

Synthesis was conducted in the same manner as in Example 8 except that in the synthesis of the polar resin in Example 8, the amount of azobisisobutyronitrile as the polymerization initiator was increased from 2 parts to 3 parts, and the polymerization temperature was raised from 90° C. to 95° C., thereby obtaining a polar resin (E) having Mw of 15,000. A developer was prepared in the same manner as in Example 8 except that this polar resin was used, and evaluated. As a result, images formed from the developer had fog to a great extent, and an unsatisfactory image was obtained in the evaluation of durability. The evaluation results are shown in Table 4.

Comparative Example 5

A developer was prepared in the same manner as in Example 8 except that zinc alkylsalicylate complex ("E-84", product of Orient Chemical Industries Ltd.) was used without using the polar resin in Example 8, and evaluated. As a result, it was found that polymerization stability was poor, and the dispersibility of the pigment was also insufficient. The evaluation results are shown in Table 4.

Comparative Example 6

Synthesis was conducted in the same manner as in Example 8 except that in the synthesis of the polar resin in Example 8, the amount of azobisisobutyronitrile as the polymerization initiator was decreased from 2 parts to 0.5 parts, and the polymerization temperature was lowered from 90° C. to 80° C., thereby obtaining a polar resin (F) having Mw of 27,000.

A developer was prepared in the same manner as in Example 8 except that the yellow pigment in Example 8 was changed to a cyan pigment ("GN-X", product of Sumika Color Co., Ltd.), and evaluated. As a result, it was found that the dispersion of the pigment was insufficient, and the image density of images formed from such a developer was low. The evaluation results are shown in Table 4.

TABLE 4

| | Example | | | | Comp. Example | | |
|---|---|---|---|---|---|---|---|
| | 8 | 9 | 10 | 11 | 4 | 5 | 6 |
| Polar resin: | A | B | C | D | E | | F |
| Amount of functional group (%) | 3 | 3 | 3 | 1 | 3 | — | 3 |
| Weight average molecular weight ($\times 10^4$) | 2.1 | 1.7 | 2.5 | 2.1 | 1.5 | — | 2.7 |
| Amount added (part) | 1 | 1 | 1 | 1 | 1 | — | 1 |
| Dispersibility of colorant | ○ | ○ | ○ | ○ | Δ | X | Δ |
| Properties of toner: | | | | | | | |
| Particle diameter (μm) | 6.7 | 6.5 | 6.4 | 6.9 | 7.6 | 10.2 | 9.3 |
| Particle diameter distribution (dv/dp) | 1.25 | 1.23 | 1.27 | 1.25 | 1.35 | 1.53 | 1.48 |
| Properties of developer: | | | | | | | |
| Volume resistivity (logρ · cm) | 11.6 | 11.4 | 11.3 | 11.4 | 11.0 | 10.8 | 11.1 |

TABLE 4-continued

| | Example | | | | Comp. Example | | |
|---|---|---|---|---|---|---|---|
| | 8 | 9 | 10 | 11 | 4 | 5 | 6 |
| Environmental dependence: | | | | | | | |
| (H/H) | ○ | ○ | ○ | ○ | X | X | Δ |
| (L/L) | ○ | ○ | ○ | ○ | Δ | Δ | Δ |
| Resolution | ○ | ○ | ○ | ○ | Δ | X | X |
| Durability | ○ | ○ | ○ | ○ | Δ | Δ | Δ |

From the results described above, it is understood that polymerized color toners which contain a colorant with good dispersibility and can provide images good in durability of image quality and excellent in resolution, can be provided by using the sulfonic group-containing copolymer (polar resin) having the specified weight average molecular weight as a charge control agent.

Example 12

(1) Synthesis of Polar Resin:

A 3-liter flask was charged with 900 parts of toluene, 71 parts of styrene, 26 parts of butyl acrylate, 3 parts of 2-acrylamido-2-methylpropanesulfonic acid and 2 parts of azobisdimethylvaleronitrile, and the resultant mixture was stirred to conduct a reaction at 90° C. for 8 hours. The solvent was then removed by distillation under reduced pressure to obtain a polar resin (G) having Mw of 21,000 and Tg of 44° C.

(2) Production of Toner:

A monomer component composed of 83 parts of styrene and 17 parts of n-butyl acrylate, 5 parts of a yellow pigment ("Toner Yellow HG VP2155", trade name; product of Clariant Co.) and 3 parts of the polar resin (G) were stirred and mixed by an ordinary stirring apparatus and then uniformly dispersed by a media type dispersing machine. Four parts of pentaerythritol tetramyristate were added to and mixed with the resultant mixture into a solution, thereby obtaining a polymerizable monomer composition.

On the other hand, an aqueous solution with 5.8 parts of sodium hydroxide (alkali metal hydroxide) dissolved in 50 parts of ion-exchanged water was gradually added to an aqueous solution with 9.5 parts of magnesium chloride (water-soluble polyvalent metallic salt) dissolved in 250 parts of ion-exchanged water under stirring to prepare a dispersion of magnesium hydroxide colloid (colloid of hardly water-soluble metal hydroxide).

The polymerizable monomer composition was poured into the colloidal dispersion of magnesium hydroxide obtained above, the mixture was stirred until droplets became stable, and 6 parts of t-butyl peroxy-2-ethylhexanoate was then added as a polymerization initiator. The resultant monomer mixture was stirred 30 minutes at 15,000 rpm under high shearing force by means of an Ebara Milder ("MDN303 V Model", manufactured by Ebara Corporation) to form fine droplets of the monomer mixture. The thus-prepared aqueous dispersion containing droplets of the monomer mixture was charged into a 10-L reactor equipped with an agitating blade to initiate a polymerization reaction at 90° C. After the reaction was continuously conducted for 8 hours, the reaction was stopped to obtain an aqueous dispersion of polymer particles having a pH of 9.5.

While stirring the above-obtained aqueous dispersion of the polymer particles, the pH of the system was adjusted to about 5.5 with sulfuric acid to conduct acid washing (25° C., 10 minutes). Filtration and hydration were then conducted, and washing water was sprayed on the residue after the dehydration to conduct water washing. Thereafter, the thus-treated residue was dried for 2 days by a dryer (at 45° C.) to obtain toner particles having a volume average particle diameter (dv) of 6.7 μm.

(3) Preparation of Developer:

To 100 parts of the toner particles obtained above were added 0.8 parts of silica ("R202", trade name; product of Degussa AG) having an average particle diameter of 14 nm subjected to a hydrophobicity-imparting treatment, and they were mixed by means of a Henschel mixer to prepare a non-magnetic one-component developer (yellow toner).

The properties of the developer thus obtained were evaluated. As a result, it was found that the developer had excellent fixing ability, shelf stability and flowability, and in the evaluation of image quality, extremely good images good in color tone, high in image density and free of fog were obtained at both high temperature and high humidity, and low temperature and low humidity. The evaluation results are shown in Table 5.

Example 13

A polar resin (H) was prepared in the same manner as in Example 8 except that the amount of styrene in Example 12 was changed from 71 parts to 78 parts, and 26 parts of butyl acrylate were changed to 19 parts of 2-ethylhexyl acrylate. The Tg of this polar resin (H) was 60° C.

A polymerized toner was obtained in the same manner as in Example 12. The thus-obtained developer was evaluated. As a result, it was found that the developer had excellent fixing ability, shelf stability and flowability, and in the evaluation of image quality, extremely good images good in color tone, high in image density and free of fog were obtained at both high temperature and high humidity, and low temperature and low humidity. The evaluation results are shown in Table 5.

Example 14

A monomer component (calculated Tg of the resulting copolymer=50° C.) composed of 78 parts of styrene and 22 parts of n-butyl acrylate, 5 parts of a magenta pigment ("Toner Magenta E-02", trade name; product of Clariant Co), 3 parts of the polar resin (G), 0.8 parts of a polymethacrylic ester macromonomer ("AA6", trade name; Tg=94° C.; product of Toagosei Chemical Industry Co., Ltd.), and 10 parts of pentaerythritol tetramyristate were stirred in an ordinary stirring device until the resulting mixture became uniform, in which 4 parts of t-butyl peroxy-2-ethylhexanoate were dissolved to obtain a polymerizable monomer composition for core.

On the other hand, an aqueous solution with 6.9 parts of sodium hydroxide (alkali metal hydroxide) dissolved in 50 parts of ion-exchanged water was gradually added to an aqueous solution with 9.5 parts of magnesium chloride (water-soluble polyvalent metallic salt) dissolved in 250 parts of ion-exchanged water under stirring to prepare a dispersion of magnesium hydroxide colloid (colloid of hardly water-soluble metal hydroxide).

The monomer composition for core was poured into the colloidal dispersion of magnesium hydroxide obtained above, and the mixture was stirred and mixed for 30 minutes at 15,000 rpm under high shearing force by means of an Ebara Milder ("MDN303 V Model", manufactured by Ebara Corporation) to form fine droplets of the monomer composition for core.

The thus-prepared aqueous dispersion containing droplets of the monomer composition for core was charged into a reactor equipped with an agitating blade to initiate a polymerization reaction at 90° C. At the time the conversion of the monomer into a polymer reached 95%, an aqueous dispersion of a monomer for shell and 25 parts of a 10% aqueous solution of ammonium persulfate were added to continue the reaction for 8 hours. The reaction was then stopped to obtain an aqueous dispersion of core-shell type polymer particles. The aqueous dispersion of the monomer for shell used herein was that prepared by subjecting 5 parts of methyl methacrylate (calculated Tg of the resulting polymer=105° C.) and 100 parts of water to a finely dispersing treatment by an ultrasonic emulsifier.

The volume average particle diameter (dv) of the colored polymer particles taken out right before the addition of the monomer for shell was 6.8 μm, and the ratio of volume average particle diameter (dv)/number average particle diameter (dp) thereof was 1.32. The thickness of the shell was 0.06 μMm as calculated out from the amount of the monomer for shell and the particle diameter of the core particles, and the rl/rs was 1.1.

While stirring the aqueous dispersion of core-shell type polymer particles obtained above, the pH of the system was adjusted to 6.0 or lower with sulfuric acid to conduct acid washing (at 25° C. for 10 minutes). After the thus-treated dispersion was filtered to separate water, 500 parts of ion-exchanged water was newly added to form a slurry again to conduct water washing. Thereafter, the dehydration and water washing were conducted repeatedly several times, and solids were then collected by filtration and dried at 45° C. for 2 days by a dryer to obtain polymer particles.

To 100 parts of the core-shell type polymer particles obtained above were added 0.8 parts of colloidal silica ("R202", trade name; product of Degussa AG) subjected to a hydrophobicity-imparting treatment, and they were mixed by means of a Henschel mixer to prepare a capsule toner.

The fixing temperature of the polymerized toner obtained above was measured and found to be 120° C. The shelf stability of this toner was 3% and hence very good. The results are shown in Table 5. Besides, the evaluation of image revealed that images high in image density, free of fog and unevenness and extremely good in resolution were obtained.

Example 15

A cyan toner was obtained in the same manner as in Example 14 except that the polar resin (G) and the magenta pigment were changed to 3 parts of the polar resin (H) and parts of a cyan pigment ("GN-X", trade name; product of Sumika Color Co., Ltd.), respectively. A developer was prepared in the same manner as in Example 12 and evaluated. As a result, it was found that the developer had excellent fixing ability and shelf stability, and in the evaluation of image quality, extremely good images good in color tone, high in image density and free of fog were obtained at both high temperature and high humidity, and low temperature and low humidity. The evaluation results are shown in Table 5.

TABLE 5

| | Example | | | |
|---|---|---|---|---|
| | 12 | 13 | 14 | 15 |
| Polar resin: | G | H | G | H |
| Amount of functional group (%) | 3 | 3 | 3 | 1 |
| Weight average molecular weight ($\times 10^4$) | 2.1 | 1.7 | 2.1 | 1.8 |
| Glass transition temperature (° C.) | 44 | 60 | 44 | 60 |
| Amount added (part) | 3 | 3 | 3 | 3 |
| Pigment | Yellow | Yellow | Magenta | Cyan |
| Amount added (part) | 5 | 5 | 5 | 5 |
| Particle diameter of toner Dv (μm) | 6.7 | 6.5 | 6.9 | 7.2 |
| Particle diameter distribution (dv/dp) | 1.3 | 1.2 | 1.3 | 1.3 |
| Spheroidicity | 1.1 | 1.1 | 1.2 | 1.1 |
| Particle diameter of core (μm) | — | — | 6.8 | 7.1 |
| Thickness of shell (μm) | — | — | 0.06 | 0.06 |
| Environmental dependence: | | | | |
| (H/H) | ○ | ○ | ○ | ○ |
| (L/L) | ○ | ○ | ○ | ○ |
| Durability | ○ | ○ | ○ | ○ |
| Shelf stability (%) | 4 | 2 | 3 | 2 |
| Flowability | 65 | 66 | 68 | 64 |
| Fixing temperature (° C.) | 135 | 140 | 120 | 125 |

From the results described above, it is understood that toners for development of electrostatic images capable of providing developers which have excellent fixing ability and shelf stability and can provide images good in durability of image quality and excellent in resolution, can be obtained by controlling the Tg of the polar resin to preferably 30 to 70° C.

INDUSTRIAL APPLICABILITY

According to the present invention, there are provided toners for development of electrostatic images, which involve no problem of safety, have excellent charge stability, are capable of successfully dispersing a colorant therein and can provide images good in durability and low in environmental dependence and excellent in resolution, and a production process thereof.

According to the present invention, there are also provided toners for development of electrostatic images, which have a low fixing temperature, are well balanced between shelf stability and fixing ability, can meet the speeding-up of printing, and are suitable for use as a color toner, and a production process thereof. According to the present invention, there are further provided color toners for development of electrostatic images, which have such excellent properties as described above.

The toners of the core-shell structure according to the present invention have excellent printing properties, can be fixed at a temperature lower than the conventional fixing temperature, have excellent fixing ability even in high-speed printing or copying, cause no color irregularity even in color printing or copying and can be suitably used in general printers and copying machines.

The polymerized color toners according to the present invention have excellent charge stability, are capable of successfully dispersing a colorant therein, can provide images good in durability and low in environmental dependence, and cause no color irregularity even in color printing or copying.

In particular, the toners according to the present invention making use of a polar resin having a low Tg have excellent charge stability, can provide images good in durability and low in environmental dependence, also have fixing ability and shelf stability and cause no color irregularity even in printing or copying.

What is claimed is:

1. A toner for development of electrostatic images, comprising at least a binder resin, a colorant and a charge control agent, wherein the charge control agent is a polar resin composed of a copolymer of a vinyl monomer and $SO_3X$ group-containing (meth)acrylamide and having an $SO_3X$ (group-containing (meth)acrylamide unit content of 0.1 to 10 wt. % and a weight average molecular weight of 17,000 to 25,000, wherein X is H or alkali metal.

2. The toner for development of electrostatic images according to claim 1, wherein the glass transition temperature of the polar resin is 30 to 80° C.

3. The toner for development of electrostatic images according to claim 1, wherein the polar resin is contained in a proportion of 0.1 to 7 parts by weight per 100 parts by weight of the binder resin.

4. The toner for development of electrostatic images according to claim 1, wherein the colorant is carbon black having a primary particle diameter of 20 to 50 nm.

5. The toner for development of electrostatic images according to claim 1, wherein the colorant is a colorant for full color.

6. The toner for development of electrostatic images according to claim 1, which has a volume average particle diameter of 1 to 12 μm, a particle diameter distribution (volume average particle diameter/number average particle diameter) of at most 1.7 and a spheroidicity of 1.0 to 1.3.

7. The toner for development of electrostatic images according to claim 1, which comprises colored polymer particles obtained by subjecting a monomer composition containing at least a polymerizable monomer, the colorant and the charge control agent to suspension polymerization in an aqueous dispersion medium containing a dispersion stabilizer.

8. The toner for development of electrostatic images according to claim 1, which has a core-shell structure that a coating layer formed of a resin having a glass transition temperature higher than the glass transition temperature of the binder resin is formed on each surface of colored resin particles containing at least the binder resin, colorant and charge control agent.

9. The toner for development of electrostatic images according to claim 1, which has a core-shell structure that a polymer layer, which covers each of colored polymer particles obtained by subjecting a monomer composition containing at least a polymerizable monomer, the colorant and the charge control agent to suspension polymerization in an aqueous dispersion medium containing a dispersion stabilizer, is formed by subjecting a polymerizable monomer for shell, which is capable of forming a polymer having a glass transition temperature higher than the glass transition temperature of a polymer formed from the first mentioned polymerizable monomer, to suspension polymerization in the presence of the colored polymer particles.

10. The toner for development of electrostatic images according to claim 9, wherein the thickness of the polymer layer which becomes a shell is 0.001 to 1.0 μm.

11. A process for producing a toner for development of electrostatic images by subjecting a monomer composition containing at least a polymerizable monomer, a colorant and a charge control agent to suspension polymerization in an aqueous dispersion medium containing a dispersion stabilizer, the process comprising using, as the charge control agent, a polar resin composed of a copolymer of a vinyl monomer and $SO_3X$ group-containing (meth)acrylamide and having an $SO_3X$ group-containing (meth)acrylamide unit content of 0.1 to 10 wt. % and a weight average molecular weight of 17,000 to 25,000, wherein X is H or alkali metal.

12. A process for producing a toner of a core-shell structure for development of electrostatic images by subjecting a monomer composition containing at least a first polymerizable monomer, a colorant and a charge control agent to suspension polymerization in an aqueous dispersion medium containing a dispersion stabilizer, thereby forming colored polymer particles, and then subjecting a second polymerizable monomer for shell, which is capable of forming a polymer having a glass transition temperature higher than the glass transition temperature of a polymer formed from the first polymerizable monomer, to suspension polymerization in the presence of the colored polymer particles to form a polymer layer which covers each of the colored polymer particles, the process comprising, using, as the charge control agent, a polar resin composed of a copolymer of a vinyl monomer and $SO_3X$ group-containing (meth)acrylamide and having an $SO_3X$ group-containing (meth)acrylamide unit content of 0.1 to 10 wt. % and a weight average molecular weight of 17,000 to 25,000, wherein X is H or alkali metal.

* * * * *